United States Patent [19]

Hergt et al.

[11] 4,239,453

[45] Dec. 16, 1980

[54] MEANS FOR REDUCING CAVITATION-INDUCED EROSION OF CENTRIFUGAL PUMPS

[75] Inventors: Peter Hergt, Ludwigshafen; Peter Buschsieper, Freinsheim; Heinz-Bernd Matthias, Frankenthal, all of Fed. Rep. of Germany

[73] Assignee: Klein, Schanzlin & Becker AG., Frankenthal, Fed. Rep. of Germany

[21] Appl. No.: 13,624

[22] Filed: Feb. 21, 1979

Related U.S. Application Data

[63] Continuation of Ser. No. 747,616, Dec. 6, 1976, abandoned.

[30] Foreign Application Priority Data

Dec. 27, 1975 [DE] Fed. Rep. of Germany ..... 2588403

[51] Int. Cl.[3] ..... F01D 25/24

[52] U.S. Cl. ..... 415/182; 415/219 A; 415/219 C; 415/206

[58] Field of Search ..... 415/DIG. 1, 219 A, 219 C, 415/182, 206

[56] References Cited

U.S. PATENT DOCUMENTS

| | | | |
|---|---|---|---|
| 2,010,525 | 8/1935 | McHugh | 415/206 |
| 2,291,138 | 7/1942 | Blom | 415/206 |
| 2,671,406 | 3/1954 | Waller | 415/206 |
| 2,677,327 | 5/1954 | MacNeille et al. | 415/206 |
| 3,307,776 | 3/1967 | White | 415/DIG. 1 |
| 3,976,390 | 8/1976 | Silvern et al. | 415/DIG. 1 |
| 4,029,430 | 6/1977 | Fonda-Bonardi | 415/DIG. 1 |

FOREIGN PATENT DOCUMENTS

| | | | |
|---|---|---|---|
| 954392 | 4/1964 | United Kingdom | 415/182 |

*Primary Examiner*—Robert E. Garrett

*Attorney, Agent, or Firm*—Peter K. Kontler

[57] ABSTRACT

Erosion of parts owing to cavitation in the part-load region of operation of a centrifugal pump is reduced or eliminated by equipping the pump with an annular diffuser which is installed upstream of the annular intake of the impeller. The impeller portion immediately downstream of the inlet edge, where the vanes begin, is bounded by a surface which diverges at an angle of 8 to 20 degrees, as considered in the direction of fluid flow in the impeller. The diffuser has a smaller first cross section which is remote from and a larger second cross section which is nearer to the impeller. The area of the smaller cross section is between one-half and nine-tenths of the area of the larger cross section. If the diffuser has a conical internal surface, the angle of divergence of such conical surface (as considered in the direction of fluid flow toward the impeller) is between 5 and 15 degrees. If the diffuser is internally stepped, the ratio of its length to the diameter of the larger cross section is between 0.2 to one and one to one.

10 Claims, 4 Drawing Figures

MEANS FOR REDUCING CAVITATION-INDUCED EROSION OF CENTRIFUGAL PUMPS

This is a continuation of application Ser. No. 747,616, filed Dec. 6, 1976 now abandoned.

BACKGROUND OF THE INVENTION

The present invention relates to centrifugal pumps in general, and more particularly to improvements in means for reducing or eliminating the effects of cavitation in part-load region of operation of centrifugal pumps. Still more particularly, the invention relates to improvements in means for reducing or eliminating cavitation in centrifugal pumps of the type wherein the shaft which drives the impeller or impellers extends through the fluid-admitting inlet of the pump.

In a conventional centrifugal pump which is to operate within a wide range of capacities, and wherein the optimum rate of inflow of fluid takes place at the design duty point, the parts undergo extensive wear owing to cavitation whenever the pump is operated in part-load region. The undesirable effects of cavitation are more pronounced in larger centrifugal pumps, and the wear owing to cavitation increases with increasing rotational speed. Attempts to reduce the wear which is attributable to cavitation include limiting the interval of operation in the part-load region, utilizing highly wear-resistant materials for those parts which are most likely to be affected by cavitation and/or providing inserts which are installed in regions where the effects of cavitation are most likely to induce rapid wear or destruction and to provide for replacement of such inserts at regular intervals or when the need arises.

The reasons for pronounced cavitation during operation in the part-load region are manifold. They include the following: When the rate of flow (capacity) is less than 60–70 percent of the flow rate at the design duty point, a ring-shaped eddy develops in the outer zone of the intake of the impeller (such eddy is known as part load eddy). The flow of fluid which forms the eddy is in a direction away from the impeller and counter to the direction of inflowing fluid. The intensity of the eddy increases in response to decreasing rate of flow into the impeller, i.e., the eddy constricts the inlet at a rate which increases with decreasing capacity. The annular stream of inflowing fluid, whose outer radius decreases with decreasing rate of flow, enters the pump at the same speed as when the operating point matches the design duty point; however, the relative speed of fluid in the hub region of the impeller is lower.

The just discussed phenomenon entails a reduction of the NPSH (net positive suction head) for incipient cavitation ($NPSH_i$) when the pump is operated in the part-load region, i.e., when the operating point is such as to permit for development of part load eddies. The formation of a part load eddy is affected by the presence of ribs, elbows or other structural elements at the inlet, and such influence upon the eddy results in an increase (rather than a decrease) of $NPSH_i$ to a multiple of the anticipated value. Thus, damage owing to cavitation is very pronounced especially since (and as already pointed out above) the optimum rate of fluid flow takes place only at the design duty point.

OBJECTS AND SUMMARY OF THE INVENTION

An object of the invention is to provide a centrifugal pump with novel and improved means for eliminating or reducing the detrimental effects of cavitation in the part-load region of operation.

Another object of the invention is to provide a centrifugal pump with simple, inexpensive, compact, long-lasting and reliable means for eliminating or reducing the effects of cavitation when the operating point is lower than the design duty point.

A further object of the invention is to provide a centrifugal pump with novel and improved means for controlling part load eddies in the region of the intake of the impeller.

An additional object of the invention is to provide a novel and improved diffuser or guide wheel for use in a centrifugal pump of the above outlined character.

The invention is embodied in a centrifugal pump which comprises a rotary impeller having an annular intake for admission of fluid and a surface located immediately downstream of the suction or inlet edge (where the vanes begin) and diverging, in the direction of fluid flow, at an angle of 8 to 20 degrees, and a diffuser which is located upstream of the intake and defines a passage having a first cross-section of smaller area and remote from the intake and a second cross section of larger area nearer to the intake. The smaller area is between one-half and nine-tenths of the larger area.

If the diffuser has a conical internal surface which diverges in the direction of fluid flow toward the intake of the impeller, the angle of divergence of the conical surface is between 5 and 15 degrees.

If the diffuser is internally stepped, the ratio of its length to the diameter of the second or larger cross section is between 0.2 to one and one to one. The internal step of the diffuser can be defined by an annular shoulder which extends substantially radially of the diffuser axis or by a shoulder bounded by a concave annular surface which faces the impeller.

The downstream portion of the diffuser may be rigid with the impeller; in fact, such portion of the diffuser may constitute an integral part of the impeller.

The novel features which are considered as characteristic of the invention are set forth in particular in the appended claims. The improved centrifugal pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
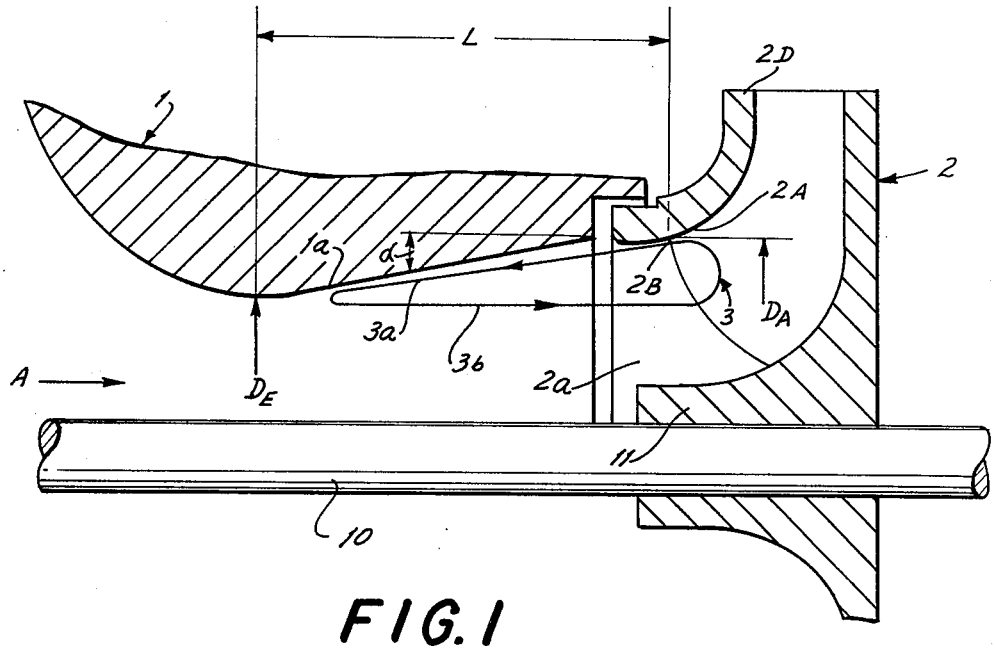
FIG. 1 is a fragmentary axial sectional view of a centrifugal pump which embodies one form of the invention and utilizes a diffuser having a conical internal surface.

FIG. 1 shows a portion of a centrifugal pump wherein a diffuser 1 is installed upstream of a closed impeller 2. The pump shaft which drives the impeller 2 and extends through the annular hub 11 is shown at 10. In the part-load region of operation, there develops a part load eddy 3 which issues from the impeller 2 and flows counter (arrow 3*a*) to the direction (arrow A) of inflowing fluid. The eddy 3 rotates with the impeller 2 and the peripheral component of its rotational speed equals or approximates the speed of the adjacent portion of the impeller. The axial component of the speed of the eddy 3 is very small. The outer portion (arrow 3*a*) of the eddy 3 flows along the conical internal surface 1*a* of the diffuser 1 and is ultimately forced radially inwardly to thereupon flow in the direction indicated by arrow A (as at 3*b*). Thus, the peripheral component increases and the static pressure decreases in accordance with the Bernoulli equation. The innermost portion (arrow 3*b*) of the eddy 3 meets the stream of inflowing fluid whose impulse is relatively high owing to the restriction, caused by the eddy 3, of the cross-sectional area of the diffuser passage which remains available for the inflowing fluid. The just mentioned impulse and the aforediscussed drop in static pressure suffice to cause a change (reversal) in the direction of flow of fluid which forms the eddy 3 if the diffuser 1 is dimensioned in accordance with one feature of the invention, namely if the diffuser has a conical internal surface 1*a* whose angle (alpha) of divergence (as considered in the direction indicated by arrow A) is between 5 and 15 degrees, if the cross-sectional area at the diameter $D_E$ of the diffuser passage is between one-half and nine-tenths of the cross-sectional area of the difuser passage in the region of the diameter $D_A$, and if the angle of divergence of the internal surface 2A downstream of the inlet edge 2B (where the vanes 2D begin) is between 8 and 20 degrees. The length L of the diffuser 1 is measured between the narrowest portion of the diffuser passage (having the diameter $D_E$) and the inlet edge 2B of the impeller 2 where the intake 2*a* terminates and the surface 2A begins.

Figure 2:
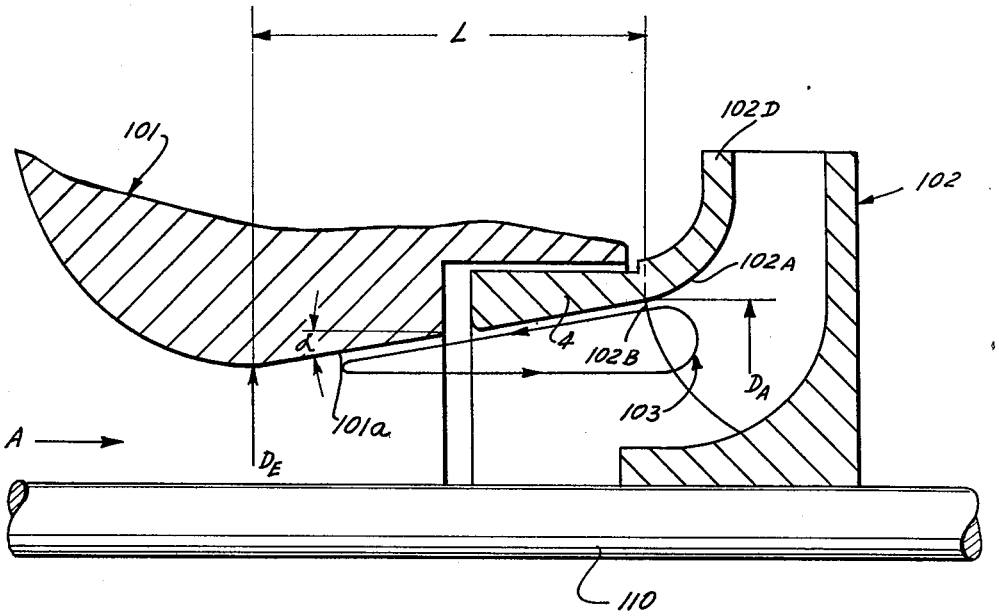
FIG. 2 is a similar fragmentary axial sectional view of a centrifugal pump which constitutes a modification of the pump shown in FIG. 1.

FIG. 2 shows a portion of a modified centrifugal pump wherein the diffuser includes a discrete annular portion 101 and an annular portion 4 of the impeller 102. The part load eddy is shown at 103, the pump shaft at 110, and the direction of fluid flow into the impeller is again indicated by arrow A. The portion 4 can be said to constitute a neck which forms an integral part of the impeller 102 and whose inner diameter decreases in a direction counter to that indicated by arrow A. Such inner diameter is between $D_E$ and $D_A$. The conical internal surface 101*a* of the diffuser portion 101 is an extension of the conical internal surface of the portion 4 which terminates at the inlet edge 102B where the vanes 102D begin. The angle of divergence of the surface 102A is between 8 and 18 degrees.

It has been found that the effects of cavitation upon a centrifugal pump which embodies the aforediscussed features (a diffuser located upstream of the impeller and having a conical internal surface which diverges at an angle of 5–15 degrees, with a diffuser passage wherein the cross sectional area with diameter $D_E$ is between one-half and nine-tenths of cross sectional area with diameter $D_A$, and with an impeller whose internal surface diverges at an angle of 8–20 degrees immediately downstream of the inlet edge) are much less pronounced than in the absence of such features. The divergent conical inner surface of the diffuser forces the outer portion of the part load eddy to flow radially inwardly. The peripheral component of rotational speed of the eddy at the locus where the eddy issues from the impeller 2 approximates the RPM of the adjacent portion of the impeller, and its axial component is relatively small. This results in an increase of peripheral component (because r. $c_u$=constant) and the static pressure decreases in accordance with the Bernoulli equation. The eddy meets the inflowing fluid in the region of the diameter $D_E$, i.e., where the impulse of the inflowing fluid is high because the cross-sectional area which is available for inflowing fluid is small. As stated above, the impulse, together with the drop of static pressure, suffices to cause a reversal in the direction of flow of fluid which forms the eddy. This insures that the parts which are located upstream of the impeller 2 do not disturb the eddy 3 and maintain the positive effect of the eddy upon the progress of $NPSH_i$.

The pronounced conicity of the internal surface of the diffuser tends to separate the stream from such surface. The resulting low-energy field in the region of the internal surface is led away through the impeller (such inlet exhibits the aforediscussed configuration, i.e., it diverges at an angle of 8 to 20 degrees immediately downstream of the inlet edge). As mentioned above, the smallest cross-sectional area (diameter $D_E$) of the diffuser passage is dimensioned to insure a maximum rate of flow at the design duty point.

An important feature of the improved pump is that the aforediscussed configuration of the diffuser, in combination with the aforediscussed configuration of the impeller downstream of the diffuser, insures that the range of operating points without cavitation is much wider than in conventional centrifugal pumps. In other words, the improved pump eliminates all such undesirable follow-up effects which are observable in presently known pumps. This insures that the foremost portion of the impeller is not subject to erosion, even if the pump is operated in the part-load region for extended periods of time. Thus, the useful life of the impeller is longer and the operation of the pump is more reliable. Moreover, the pump can be operated in part-load region with a very low rate of flow (i.e., at a capacity which is a fraction of minimum permissible capacity of conventional pumps in the part-load region of operation) without any risk of subjecting the parts to pronounced erosion as a result of cavitation. The lower limit of capacity is determined solely by the minimum rate of flow which is required for thermal reasons.

Figure 4:
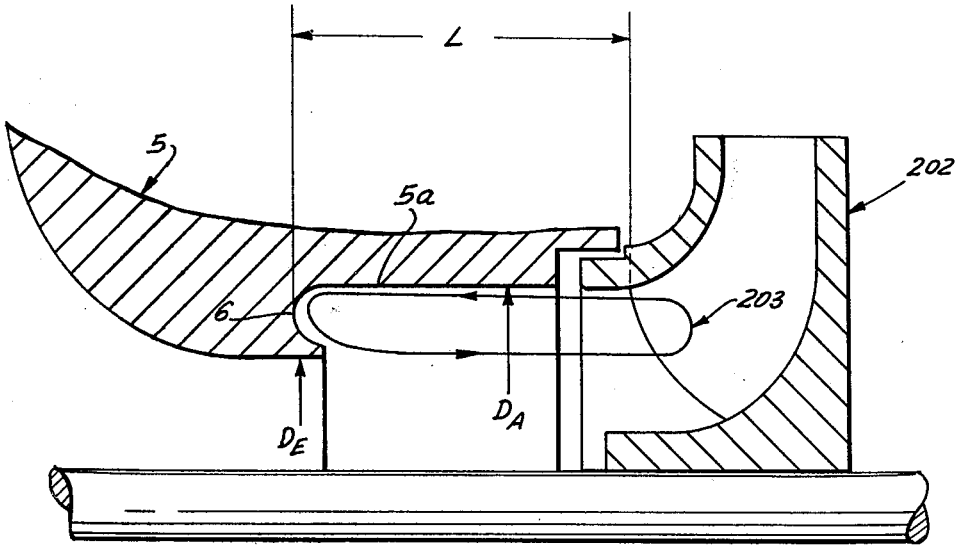
FIG. 4 is a similar fragmentary axial sectional view of a centrifugal pump which constitutes a modification of the pump shown in FIG. 3.

It was already proposed to provide a centrifugal pump with an intake which diverges in the direction of fluid flow toward and into the impeller. Reference may be had to German Pat. No. 699,743 wherein the FIG. 4 shows a pump with an adapter which is intended to establish a transition between an elbow and the intake of the impeller. The adapter is not comparable to the diffuser which is used in the centrifugal pump of the present invention. Moreover, the intake of the impeller which is shown in FIG. 4 of the aforementioned German patent has a circular cylindrical internal surface of constant diameter. Such configuration of the impeller intake is not conducive to cavitation in the part-load region of operation; however, it exhibits well known serious drawbacks when the pump is operated at the design duty point. Still further, the impeller which is disclosed in the German patent is composed of several sections which cause the pump to operate in an entirely different way, especially in the part-load region.

FIG. 1 of German Pat. No. 1,176,485 shows a conventional diffuser whose purpose is to convert the kinetic energy of inflowing fluid into pressure. The angle of divergence of the diffuser is between 2 and 4 degrees; it should not exceed 4 degrees because this would result in separation of inflowing fluid from the diffuser surface. The objects and solutions which are disclosed in this German patent are basically different from the objects and features of the present invention.

Figure 3:
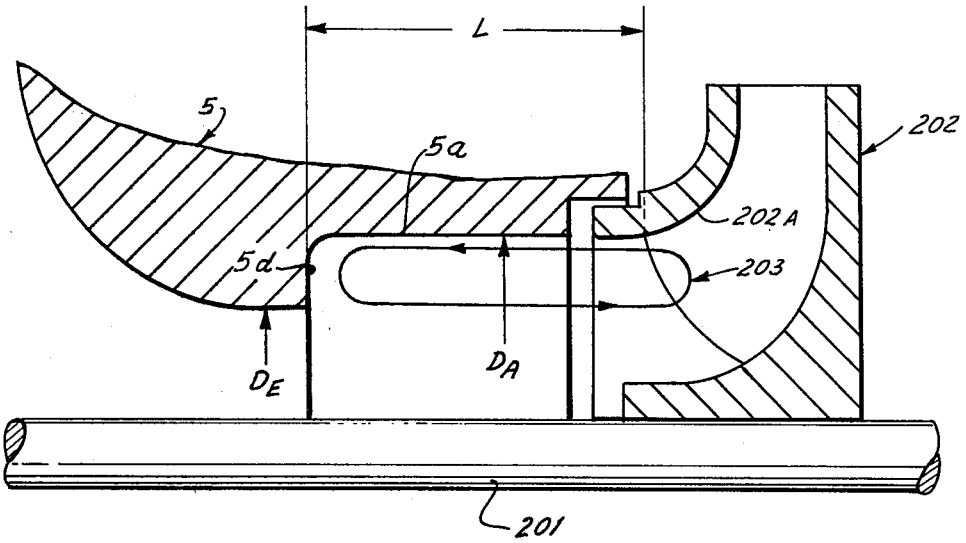
FIG. 3 is a fragmentary axial sectional view of a centrifugal pump with an internally stepped diffuser.

FIG. 3 illustrates a centrifugal pump with an internally stepped diffuser 5, an impeller 202, a pump shaft 210 and a modified part load eddy 203. In this embodiment of the pump, the ratio of L to $D_A$ influences the extent of cavitation (or, more accurately stated, the reduction or elimination of cavitation). The locus of reversal in the direction of the flow of fluid which forms the eddy 203 is determined by the location of the shoulder 5*d* of the diffuser 5. The shoulder 5*d* is located between the constant cross-sectional area having the diameter $D_E$ and the constant cross-sectional area having the diameter $D_A$. The length L is measured from the shoulder 5*d* to the region where the internal surface 202A of the impeller 202 begins to diverge at an angle of between 8 and 20 degrees.

The shoulder 5*d* tends to separate the inflowing liquid from the diffuser 5, the same as the divergent conical internal surface of the diffuser shown in FIG. 1 or 2, when the pump including the structure of FIG. 3 is operated at the design duty point. The resulting low-energy field at the internal surface 5*a* of the diffuser 5 is led away by the intake of the impeller 202 which is designed in the same way as described in connection with FIG. 1 (refer to the angle of divergence in the range of between 8 and 20 degrees).

The ratio of L to $D_A$ in the pump of FIG. 3 is preferably between 0.2 to one and one to one. This is the equivalent of the feature, described in connection with FIG. 1, that the angle of divergence (see alpha in FIG. 1 or 2) in the case of a diffuser having a conical internal surface should be in the range of 5 to 15 degrees.

The structure of FIG. 4 is identical with that of FIG. 3, except that the radially extending shoulder 5*d* of FIG. 3 is replaced with an annular shoulder bounded by an annular concave surface 6 facing the impeller 202. Such configuration of the shoulder promotes the reversal in the direction of flow of the eddy 203 to an extent which is even more satisfactory than in the pump of FIG. 3.

In each of the embodiments of FIGS. 1, 3 and 4, a portion of the diffuser surrounds a portion of the impeller.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. In a centrifugal pump with a wide range of operating points without cavitation, a combination comprising a rotary impeller including a plurality of vanes and having an annular intake for admission of fluid, an inlet edge where said vanes begin, and an internal surface located immediately downstream of said inlet edge and diverging in the direction of fluid flow at an angle of between 8 and 20 degrees; and a cavitation-reducing diffuser located upstream of said intake, said diffuser defining a passage having a first cross section of smaller area which is remote from and a second cross section of larger area which is nearer to said intake, the area of said first cross section being between one-half and nine-tenths of the area of said second cross section and insuring the maximum flow rate at the design duty point.

2. A combination as defined in claim 1, wherein said diffuser has a conical internal surface surrounding said passage and diverging in a direction toward said intake at an angle of between 5 and 15 degrees.

3. A combination as defined in claim 1, wherein said diffuser is internally stepped and the ratio of the axial length of said diffuser to the diameter of said second cross section is between 0.2 to one and one to one.

4. A combination as defined in claim 1, wherein said diffuser includes a portion which is adjacent said inlet edge and rigid with said impeller.

5. A combination as defined in claim 1, wherein said impeller has at least one guide vane which begins at said inlet edge, said diffuser extending at least to said inlet edge.

6. A combination as defined in claim 1, wherein said diffuser has an internal shoulder disposed between said first and second cross sections and extending substantially radially of the axis of said impeller.

7. A combination as defined in claim 1, wherein said diffuser has an internal shoulder disposed between said first and second cross sections and bounded by an annular concave surface facing said impeller.

8. A combination as defined in claim 1, wherein said impeller has a hub which is spacedly surrounded by said surface, and further comprising a pump shaft coaxial with, extending through said diffuser and arranged to rotate said impeller through the medium of said hub.

9. A combination as defined in claim 1, wherein said diffuser has a portion which surrounds a portion of said impeller in the region of said intake.

10. A combination as defined in claim 1, wherein said passage has a first portion of constant diameter equal to the diameter of said first cross section and a second portion of constant diameter equal to the diameter of said second cross section.

* * * * *